United States Patent [19]

Pomaski

[11] 3,975,921

[45] Aug. 24, 1976

[54] EAR WIRE CONSTRUCTION

[76] Inventor: Charles J. Pomaski, 179 Kenyon Ave., East Greenwich, R.I. 02818

[22] Filed: May 27, 1975

[21] Appl. No.: 580,935

[52] U.S. Cl. ..... 63/13; 24/237

[51] Int. Cl.[2] ..... A44C 7/00

[58] Field of Search ..... 63/12, 13; 24/67.9, 24/237

[56] References Cited

UNITED STATES PATENTS

| | | | |
|---|---|---|---|
| 148,390 | 3/1874 | Tappan | 63/13 |
| 483,214 | 9/1892 | Gaynor | 63/13 |
| 1,440,628 | 1/1923 | Raub | 24/237 X |
| 1,567,851 | 12/1925 | Lorber | 24/237 |
| 1,764,451 | 6/1930 | Holmes | 24/237 X |
| 2,629,989 | 3/1953 | McDonald | 63/13 |
| 3,071,938 | 1/1963 | Davidson | 63/13 |
| 3,345,830 | 10/1967 | Fontaine | 63/13 |
| 3,408,700 | 11/1968 | Chase | 24/67.9 X |

*Primary Examiner*—F. Barry Shay
*Attorney, Agent, or Firm*—Robert J. Doherty

[57] ABSTRACT

A jewelry finding for pierced ears, namely an ear wire constructed of a single length of relatively stiff flexible wire bent into the shape of two loops, an upper U-shaped open loop which supports the finding from the ear lobe and a lower substantially closed loop which supports the ornament; both ends of the ear wire terminating in free ends and the ear wire itself being free from thickened or flattened integral or separately attached guard portions.

11 Claims, 5 Drawing Figures

EAR WIRE CONSTRUCTION

BACKGROUND OF THE INVENTION

This invention relates to an ear wire for insertion into the opening of pierced ear lobes. The ear wire is supported by the ear lobe and in turn supports an ear ornament which ornament may be exchanged with others as befits the style or occasion.

The term wire as utilized herein means any length of material including metal, plastic or other appropriate substances as well as the shape into which such wire is formed while the terms bent, etc are used in their generic sense and thus refer to the ultimate shape or configuration of the ear wire rather than the particular manner by which such was formed e.g. bending, cutting to shape, die casting, injection molding etc.

Ear wires for ear ornaments are well known and have been in common use for many years particularly in conjunction with pierced ears. One type ear wire construction are those formed from a single length of wire of which type the present invention for an ear wire is included. Such ear wires normally are provided with some type of guard feature to assure against the loss of the ornament by slipping through the remaining ear wire portion. Such guard portion is often formed by the attachment or formation of a thickened end portion such as illustrated in U.S. Pat. Nos. 427,265 and 3,071,938 or a separate wire or hook attachment to the ear wire itself from which the ornament depends by means of an additional jump ring such as illustrated in U.S. Pat. Nos. 293,958; 324,757; 711,269; 983,598; 1,561,128; D174,740 and 2,956,422 or are of an extremely complex configuration such as illustrated by U.S. Pat. Nos. 528,197; 2,009,537 and 2,629,989. These styles present disadvantages either to the user or manufacturer which it would be desirable to eliminate.

OBJECTS OF THE INVENTION

It is thus the main object of the present invention to provide a useful ear wire construction which avoids the above prior art dissadvantages and which accordingly does not require a separate or thickened ornament guard portion, a separate ornament jump ring and which is not of overly complex configuration. An additional object of the present invention to provide an ear wire construction which is simple and straight forward in use and which may be produced by known manufacturing techniques quickly without complications and at a low cost.

Another object of the invention is to provide an ear wire construction having a smooth uniform contour which avoids entanglement with hair or clothing.

Still another object of the invention is to provide an ear wire construction from which ornaments are securely fixed may be easily removed and rehung without the necessity of removing the ear wire from the ear lobe of the wearer.

These and other objects of the invention will be brought out in the following descriptive portions of the application.

DETAILED DESCRIPTION OF THE INVENTION

Figure 1:
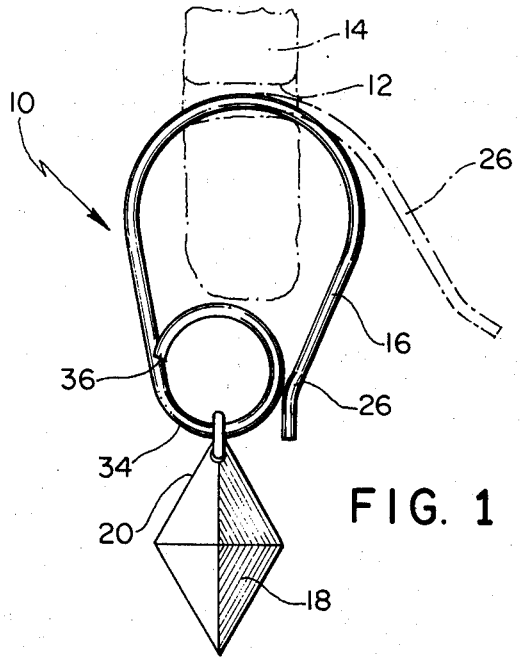
FIG. 1 is an overall view of an ear ring utilizing the ear wire construction of the present invention as worn or suspended in the opening of a pierced ear lobe.

Referring to the drawing and more particularly FIG. 1 thereof an earring 10 utilizing the novel ear wire construction of the present invention is shown suspended from the pierced opening 12 of the ear lobe 14 of the wearer. The earring 10 is composed of an ear wire 16 and an ornament 18 which is suspended from the ear wire by means of an opening directly through the ornament or by means of a permanently closed ring 20.

Figure 2:
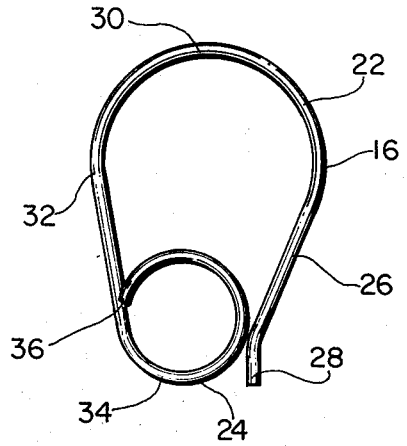
FIG. 2 is a plan view of one embodiment of the ear wire construction of the present invention.
Figure 3:
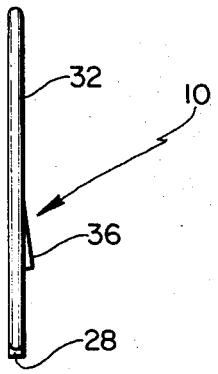
FIG. 3 is a side view thereof which in particular depicts the wire-like construction thereof.

The structure of the ear wire 16 is best depicted by reference to FIGS. 2 and 3 of the drawing wherein it may be seen that the overall configuration thereof is that of two loops; an upper loop 22 of generally U-shaped configuration and a lower loop 24 of generally circular configuration. The upper loop is formed of a relatively straight side 26 terminating in a free end 28 which end is rounded smooth to assure easy initial insertion through the ear lobe opening 12, a central cradle 30 by which the ear ring is supported by the ear lobe and a second side portion 32 which terminates by continuation into a portion of the lower loop. In this manner the open end of the larger upper loop may substantially be fully or at least partially closed by the lower loop so that the spacing, if any, therebetween is smaller than the thickness of the ear lobe at the point at which the opening is provided and lower. This assures that the ear wire will not be accidentally dislodged from the ear since the force necessary to spring open the straight side 26 to permit the ear to pass between would not occur unless purposeful as when inserting or removing the ear wire. It should be noted that the inherent spring of the wire facilitates the outward bending of the side portion 26 to its insertion position shown in phantom in FIG. 1 and once the ear wire is in place the wearer merely lets the side 26 return to its normal closed attitude.

The lower loop 24 is comprised of a cradle portion 34 which supports the ornament 18 in use and terminates in a free end 36 at a point somewhat opposed to the cradle portion and generally at a point thereabove. The lower loop is of a substantially closed configuration so that no unguarded openings are presented through which an ornament or its supporting ring could pass. The lower loop free end 36 preferably contacts and slightly crosses over a non-contiguous portion of the lower loop, that is, a portion of the wire not immediately upstream thereof. Such portion is depicted as the terminus of side 32 of the upper loop as it merges into the lower loop but may in some cases may not actually cross or contact e.g., the lower loop free end once having formed a substantially closed loop may continue in a spiral form and terminate at some point within the lower loop. Thus a flexible spring contact to close or a further wire continuation serve to assure that no unguarded openings are present in the lower loop.

In use, an ornament supported either by an opening in the ornament itself or by a supporting ring is positioned on the ear wire by threading over either free end, the wire being spring opened to permit passage past an inner loop portion downstream of the cradle 34 when inserted over the free end 28 or an inner loop portion upstream of the cradle 34 when inserted over the free end 36. The terms upstream and downstream as utilized herein refer to the directional construction of the continuous length of wire and assuming origin at the free end 28. Such placement assures retention of the ornament not only when in use but also when not in use as in storage in a jewelry box etc. The ornament can also be purposely removed over the free end 36 while the ear wire is still in place if desired to change style or color ornaments. It should also be apparent that the present ear wire configuration by providing for direct threading over the wire itself eliminates the need for a separate jump ring.

Figure 4:
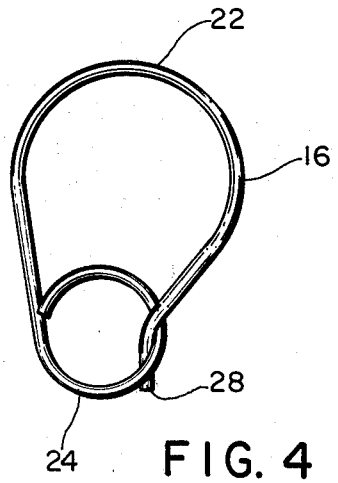
FIG. 4 is a plan view of the ear wire shown in FIG. 2 with its upper loop free end passing through the lower loop as an additional safety measure.
Figure 5:
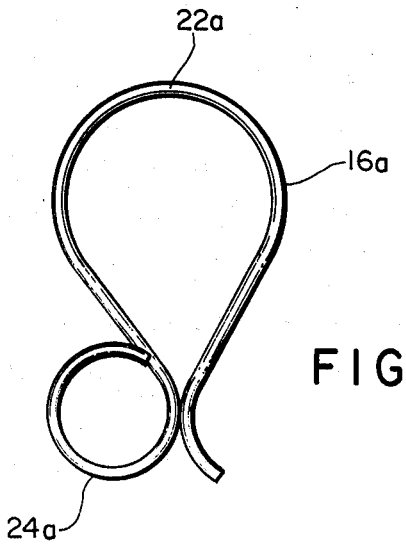
FIG. 5 is a plan view of an alternate embodiment of the invention.

Turning now to FIG. 5 of the drawing, an alternate embodiment of the ear wire construction is shown wherein the lower loop 24*a* is entirely outside the confines of the larger upper loop 22*a* but still substantially closing the open end thereof. Ear wire 16*a* operates in essentially the same manner as described in relation to the main embodiments shown in FIGS. 1–4.

An additional safety guard of the present device is shown by reference to FIG. 4 wherein the free end 28 has been inwardly bent so as to pass through the lower loop and retained therein by spring action and in contact with a portion of the lower loop downstream of the cradle portion 34 in the case of the FIGS. 1–4 embodiment and upstream thereof in the FIG. 5 embodiment. This hooking into the lower loop although not necessary for satisfactory operation of the device provides additional guards against the free end 28 being accidentally withdrawn from the ear lobe opening and in the FIGS. 1–4 embodiment, an additional guard or stop point in preventing movement of the ornament along the extent of the inner loop towards the free end thereof.

A further guard effect of the present construction is brought about in those cases where the vertical distance between the upper loop cradle and the upper portions of the lower loop is equal to or slightly less than the length of the ear lobe from the opening to its outer edge as encompassed by the loops. Thus the lobe edge serves as an added guard in preventing downstream movement of an ornament to the free end 36. Such placement also serves to stabilize the ear wire in reducing or eliminating any free swing in those cases where such action is desirable.

It is thus seen that the extremely simple ear wire construction herein described provides positive and loss free mounting without the complications of the prior art devices referred to. Such is further accomplished by a construction which may be manufactured from readily available material and utilizing straightforward forming techniques. The result is a novel, highly useful and extremely low cost ear wire.

It should be further understood that variations and modifications and special adaptions of the embodiments of the present invention may be utilized without departing from the scope of the present invention as set forth in the following claims.

I claim:

1. An ear wire for pierced ears comprising, a continuous length of generally even gauge relatively stiff, flexible, wire material having an upper substantially U-shaped loop open at its lower end and a closed lower loop of smaller size than said upper loop and of a continuously curved substantially circular configuration exhibiting no straight sidewalls positioned in the open lower end of said upper loop so as to substantially entirely close said lower end, said upper loop having an ear lobe contacting central cradle portion for supporting said ear wire in hanging relation from said ear lobe, one side portion of said upper loop terminating in a relatively straight free end for initial insertion through a pierced ear lobe opening and the other side portion thereof terminating in a portion of said lower loop, said lower loop having a lowermost cradle portion for support of an ornament and an uppermost portion in opposition to such cradle portion and terminating in a free end.

2. The ear wire construction set forth in claim 1 including separate first and second stop means for preventing an ornament suspended from the lowermost cradle portion of said lower loop from becoming disengaged from said lower loop, said first stop means comprising a point of contact between said lower loop free end and a non-contiguous portion thereof positioned above said cradle, said second stop means comprising a point of contact between said upper loop free end and that portion of the lower loop substantially entirely closing said upper loop lower end.

3. The ear wire construction set forth in claim 2 wherein said cradle portions of said upper and lower loops are in substantially vertical alignment with each other.

4. The ear wire construction set forth in claim 2 wherein said lower loop free end terminates above said cradle portion thereof.

5. The ear wire construction set forth in claim 2 wherein said upper loop free end passes through said lower loop.

6. The ear wire construction set forth in claim 1 wherein said uppermost portion of said lower loop passes across said open lower portion of said upper loop and terminates in a free end which contacts non-contiguous portions of said lower loop.

7. The ear wire construction set forth in claim 1 wherein said lower loop is disposed substantially entirely within said confines of upper loop configuration.

8. The ear wire construction set forth in claim 7 wherein said upper loop free end contacts that portion of the lower loop between the free end and cradle portions thereof.

9. The ear wire construction set forth in claim 1 wherein said lower loop is disposed substantially entirely without the confines of said upper loop configuration.

10. The ear wire construction set forth in claim 9 wherein said upper loop free end contacts that portion of the lower loop distal the free end and cradle portions thereof.

11. The ear wire construction set forth in claim 1 wherein said lower loop is dimensioned so that upper portions thereof engage lower portions of said ear lobe.

* * * * *